US006217443B1

(12) United States Patent
Green, Jr.

(10) Patent No.: US 6,217,443 B1
(45) Date of Patent: Apr. 17, 2001

(54) CARBONLESS PAPER NOTEPAD

(76) Inventor: Leonard C. Green, Jr., 4915 44th St., Lubbock, TX (US) 79414-3213

( * ) Notice: Subject to any disclaimer, the term of this patent is extended or adjusted under 35 U.S.C. 154(b) by 0 days.

(21) Appl. No.: 09/267,009

(22) Filed: Mar. 11, 1999

(51) Int. Cl.[7] ..... B42D 17/00

(52) U.S. Cl. ..... 462/19; 281/44; 462/18; 462/53; 462/54; 462/55; 462/58; 462/64; 462/72

(58) Field of Search ..... 281/44; 462/18, 462/19, 53, 54, 55, 58, 64, 72

(56) References Cited

U.S. PATENT DOCUMENTS 1,218,700 * 3/1917 Rotenberg ..... 462/55

5,248,280 * 9/1993 Lockwood et al. ..... 462/19

* cited by examiner

*Primary Examiner*—A. L. Wellington
*Assistant Examiner*—Mark T. Henderson

(57) ABSTRACT

A carbonless paper notepad for producing multiple copies of a document created on the notepad. The carbonless paper notepad includes a tablet with a plurality of sheets each having a lower face coated with a duplicating material. A top end of the tablet is coupled to a first end of a board. The board has a spaced apart pair of median folds extending between the sides of the board which divide the board into backer and underback panels. The backer panel is positioned beneath the tablet. The underback panel is inserted between adjacent sheets of the tablet beneath the upper sheet of the tablet.

6 Claims, 3 Drawing Sheets

CARBONLESS PAPER NOTEPAD

BACKGROUND OF THE INVENTION

1. Field of the Invention

The present invention relates to carbonless paper notepads and more particularly pertains to a new carbonless paper notepad for producing multiple copies of a document created on the notepad.

2. Description of the Prior Art

The use of carbonless paper notepads is known in the prior art. More specifically, carbonless paper notepads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,798,401 by Greig; U.S. Pat. No. 5,275,576 by Drake; U.S. Pat. No. 5,407,892 by Murakami et al.; U.S. Pat. No. 3,048,426 by Rodriguez et al.; U.S. Pat. No. 3,290,061 by Glassman; and U.S. Pat. No. Des. 329,876 by Breen which are all incorporated by reference herein.

While these devices fulfill their respective, particular objectives and requirements, the aforementioned patents do not disclose a new carbonless paper notepad. The inventive device includes a tablet with a plurality of sheets each having a lower face coated with a duplicating material. A top end of the tablet is coupled to a first end of a board. The board has a spaced apart pair of median folds extending between the sides of the board which divide the board into backer and underback panels. The backer panel is positioned beneath the tablet. The underback panel is inserted between adjacent sheets of the tablet beneath the upper sheet of the tablet.

In these respects, the carbonless paper notepad according to the present invention substantially departs from the conventional concepts and designs of the prior art, and in so doing provides an apparatus primarily developed for the purpose of producing multiple copies of a document created on the notepad.

SUMMARY OF THE INVENTION

In view of the foregoing disadvantages inherent in the known types of carbonless paper notepads now present in the prior art, the present invention provides a new carbonless paper notepad construction wherein the same can be utilized for producing multiple copies of a document created on the notepad.

The general purpose of the present invention, which will be described subsequently in greater detail, is to provide a new carbonless paper notepad apparatus and method which has many of the advantages of the carbonless paper notepads mentioned heretofore and many novel features that result in a new carbonless paper notepad which is not anticipated, rendered obvious, suggested, or even implied by any of the prior art carbonless paper notepads, either alone or in any combination thereof.

To attain this, the present invention generally comprises a tablet with a plurality of sheets each having a lower face coated with a duplicating material. A top end of the tablet is coupled to a first end of a board. The board has a spaced apart pair of median folds extending between the sides of the board which divide the board into backer and underback panels. The backer panel is positioned beneath the tablet. The underback panel is inserted between adjacent sheets of the tablet beneath the upper sheet of the tablet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carbonless paper notepad apparatus and method which has many of the advantages of the carbonless paper notepads mentioned heretofore and many novel features that result in a new carbonless paper notepad which is not anticipated, rendered obvious, suggested, or even implied by any of the prior art carbonless paper notepads, either alone or in any combination thereof.

It is another object of the present invention to provide a new carbonless paper notepad which may be easily and efficiently manufactured and marketed.

It is a further object of the present invention to provide a new carbonless paper notepad which is of a durable and reliable construction.

An even further object of the present invention is to provide a new carbonless paper notepad which is susceptible of a low cost of manufacture with regard to both materials and labor, and which accordingly is then susceptible of low prices of sale to the consuming public, thereby making such carbonless paper notepad economically available to the buying public.

Still yet another object of the present invention is to provide a new carbonless paper notepad which provides in the apparatuses and methods of the prior art some of the advantages thereof, while simultaneously overcoming some of the disadvantages normally associated therewith.

Still another object of the present invention is to provide a new carbonless paper notepad for producing multiple copies of a document created on the notepad.

Yet another object of the present invention is to provide a new carbonless paper notepad which includes a tablet with a plurality of sheets each having a lower face coated with a duplicating material. A top end of the tablet is coupled to a first end of a board. The board has a spaced apart pair of median folds extending between the sides of the board which divide the board into backer and underback panels. The backer panel is positioned beneath the tablet. The underback panel is inserted between adjacent sheets of the tablet beneath the upper sheet of the tablet.

Still yet another object of the present invention is to provide a new carbonless paper notepad that is preferably constructed in standard 8½" by 14" legal pad size but that may also be constructed any size pad including 8½" by 11", A4, and 4" by 5" pads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
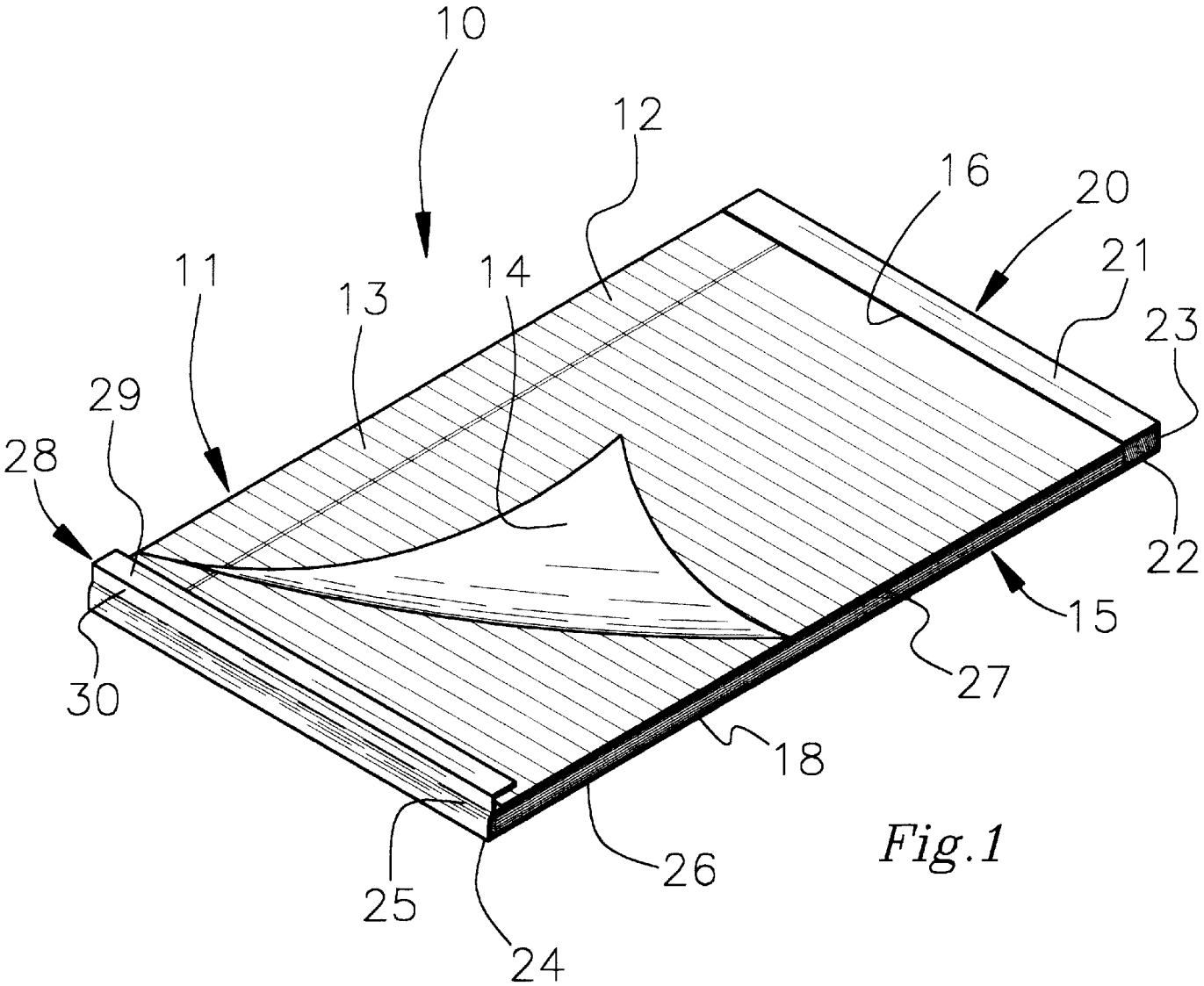
FIG. 1 is a schematic perspective view of a new carbonless paper notepad according to the present invention.
Figure 2:
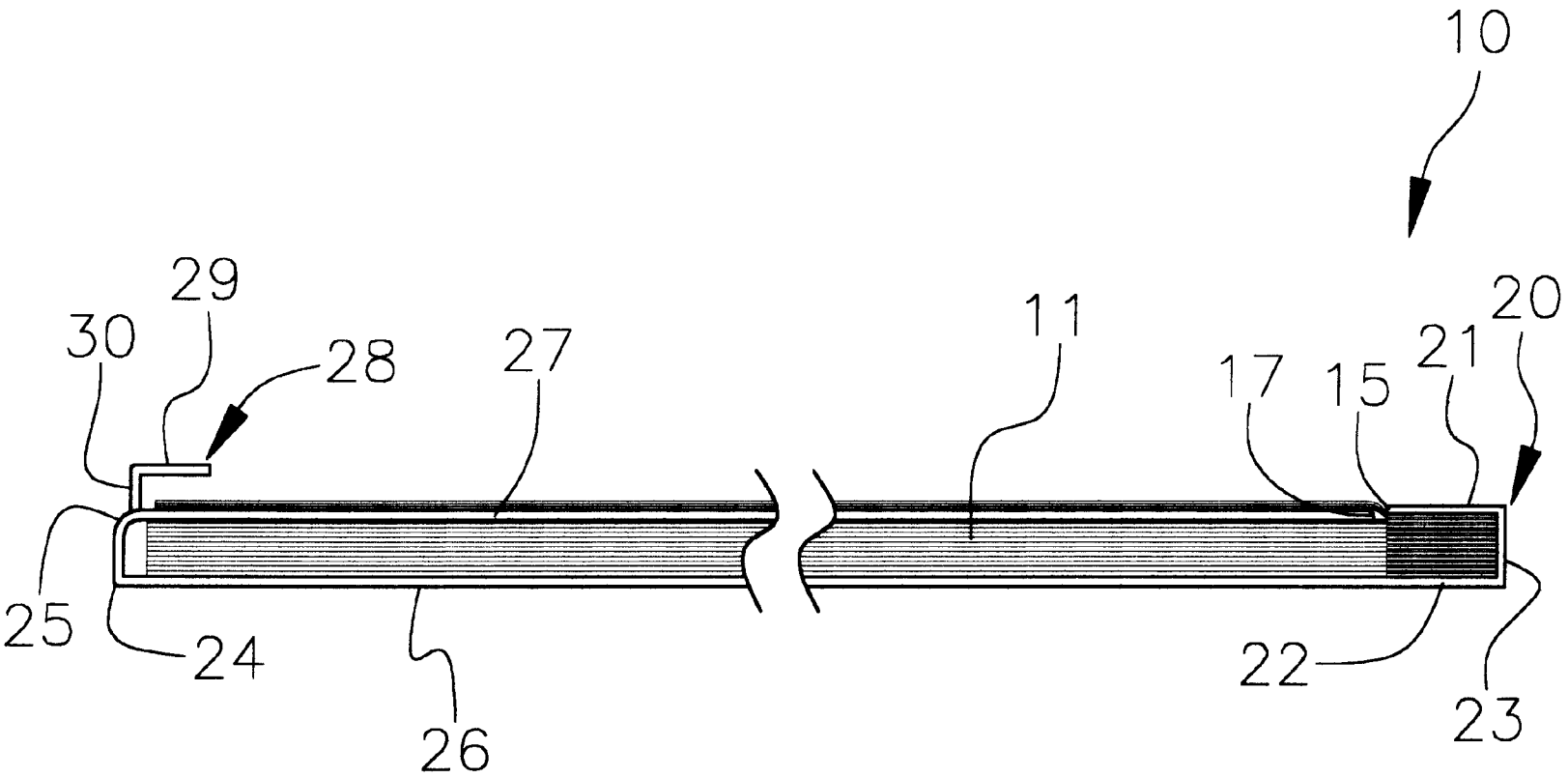
FIG. 2 is a schematic side view of the present invention.
Figure 3:
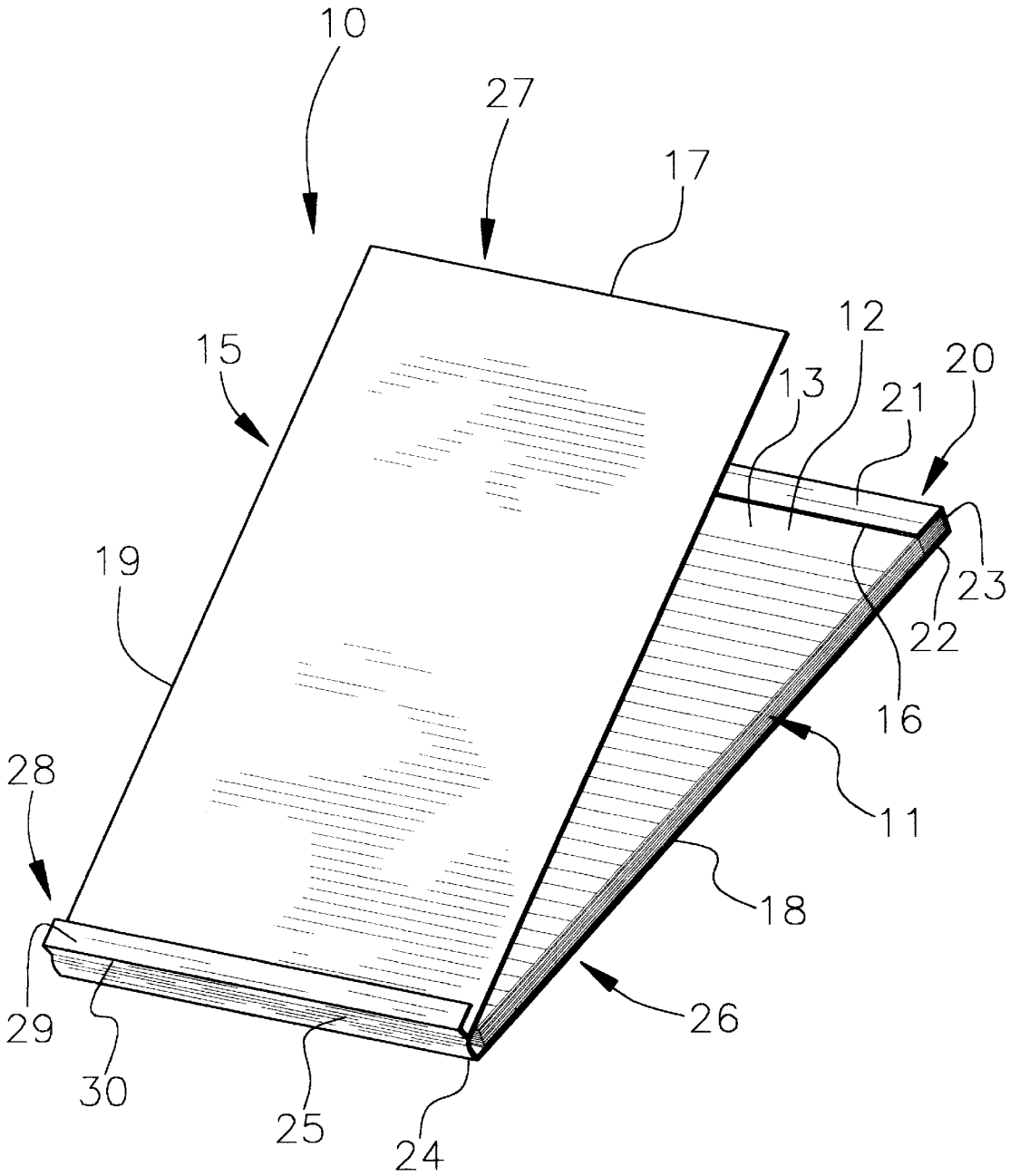
FIG. 3 is a schematic perspective view of the present invention with the underback panel lifted up.

With reference now to the drawings, and in particular to FIGS. 1 through 3 thereof, a new carbonless paper notepad embodying the principles and concepts of the present invention and generally designated by the reference numeral 10 will be described.

As best illustrated in FIGS. 1 through 3, the carbonless paper notepad 10 generally comprises a tablet with a plurality of sheets each having a lower face coated with a duplicating material. A top end of the tablet is coupled to a first end of a board. The board has a spaced apart pair of median folds extending between the sides of the board which divide the board into backer and underback panels. The backer panel is positioned beneath the tablet. The underback panel is inserted between adjacent sheets of the tablet beneath the upper sheet of the tablet.

In closer detail, the notepad 10 comprises a generally rectangular tablet 11 having substantially straight top and bottom ends, and a pair of substantially straight sides extending between the ends of the tablet. The ends of the tablet are preferably extended substantially parallel to one another. The sides of the tablet are preferably extended substantially parallel to one another and substantially perpendicular to the ends of the tablet. The tablet comprises a plurality of generally rectangular sheets 12 coupled together at a spine formed along the top end of the tablet. The plurality of sheets are arranged in a stack in the tablet having a top sheet and a bottom sheet.

Each of the sheets of the tablet has generally rectangular upper and lower faces 13,14. The upper face of each sheet preferably has a plurality of spaced apart and substantially parallel guide lines extending between the sides of the tablet. Even more preferably, the upper face of each sheet has a ledger line extending between the ends of the tablet adjacent one of the sides of the tablet. The lower faces of the sheets each have a coating of duplicating material (i.e., a carbonless copy coating) whereby applying localized pressure to the upper face of a first sheet to form a mark such as from writing on the upper sheet transfers pressure to the lower face of the first sheet such that the coating of duplicating material forms a copy of the mark on to a second sheet beneath the first sheet. Ideally, the coating of duplicating material is colored to produce a black colored copy of the mark on the second sheet.

A generally rectangular board 15 is provided having a pair of substantially straight opposite ends 16,17, and a pair of substantially straight sides 18,19 extending between the ends of the board. Ideally, the board comprises a plastic material although it may also optionally be constructed of cardboard. The ends of the board are preferably extended substantially parallel to one another. The sides of the board are preferably extended substantially parallel to one another and substantially perpendicular to the ends of the board.

The board has a spaced apart pair of substantially parallel upper folds extending between the sides of the board which are positioned towards a first of the ends of the board. The upper folds of the board are preferably extended substantially parallel to the ends of the boards and substantially perpendicular to the sides of the board. The upper folds of the board define a generally rectangular U-shaped spine region 20 having spaced apart upper and lower portions 21,22, and a top portion 23 connecting together the upper and lower portions of the spine region together. The top end of the tablet is inserted into the spine region positioned between the upper and lower portions of the spine region and positioned adjacent the top portion of the spine region. The top end of the tablet is also preferably adhesively coupled to the spine region. Preferably, a first of the sides of the tablet and a first of the sides of the board generally lie in a common plane with one another and a second of the sides of the tablet and a second of the sides of the board generally lie in a common plane with one another. Ideally, the common planes of the sides of the tablet and board are substantially parallel to one another.

The board has a spaced apart pair of substantially parallel median folds 24,25 extending between the sides of the board. The median folds are preferably extended substantially parallel to the ends of the board and substantially perpendicular to the sides of the board. In use, the median folds functioning as living hinges to permit pivoting of the board at each median fold. Ideally, at least one of the median folds 25 is rounded to prevent discomfort to the forearm of a user writing on the tablet when in contact with the median folds.

The tablet is positioned between the spine region and the median folds of the board with the bottom end of the tablet positioned adjacent the median folds of the board. The median folds of the board divide the board into generally rectangular backer and underback panels 26,27. The backer panel is positioned between the median folds and the spine region of the board. The backer panel is positioned beneath the bottom sheet of the tablet.

The underback panel is positioned between the median folds and a second of the ends of the board. The underback panel is extended from the median folds towards the spine region of the board. The underback panel is inserted between adjacent sheets of the tablet beneath the upper sheet of the tablet so that the second end of the board is positioned adjacent the spine region of the board. Preferably, at least two sheets of the tablet are positioned about the underback panel: a top sheet for writing on; and a bottom sheet for forming a copy of the mark on the top sheet with the coating of duplicating material.

The underback panel has an upwardly extending generally L-shaped clip strip 28 extending between the sides of the board. The clip strip is positioned adjacent the median folds and is extended substantially parallel to the ends of the board and substantially perpendicular to the sides of the board. The clip strip has generally rectangular elongate upper and lower portions 29,30 extending substantially perpendicular to one another. The lower portion of the clip strip is coupled to the underback panel. The upper portion of the clip strip is extended from the lower portion of the clip strip towards the second end of the board. The upper portion of the clip strip and the underback panel define a lower channel therebetween extending between sides of the board. In use, the sheets of the tablet positioned above the underback panel each have their lower end edges inserted into the lower channel defined between the upper portion of the clip strip and the underback panel. This way, the clip strip helps hold the lower end edges of the top sheets in the lower channel when a user is writing on the upper sheet.

The tablet has a length defined between the top and bottom ends of the tablet and a width defined between the sides of the tablet. Ideally, length of the tablet is about 14 inches and the width of the tablet is about 8½. Optionally, the tablet may have A4 sized sheet dimensions, 8" by 11" dimensions, and even 4" by 5" dimensions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A notepad, comprising:

a tablet having top and bottom ends, and a pair of sides extending between said ends of said tablet;

said tablet comprising a plurality of sheets coupled together along said top end of said tablet, said plurality of sheets being arranged in a stack in said tablet having a top sheet and a bottom sheet;

each of said sheets of said tablet having upper and lower faces;

said lower faces of said sheets each having a coating of duplicating material whereby applying localized pressure to said upper face of a first sheet to form a mark transfers pressure to the lower face of the first sheet such that said coating of duplicating material forms a copy of the mark on to a second sheet beneath the first sheet;

a board having a pair of opposite ends, and a pair of sides extending between said ends of said board;

said top end of said tablet being coupled to a first end of said board;

said board having a spaced apart pair of median folds extending between said sides of said board;

said median folds of said board dividing said board into generally rectangular backer and underback panels;

said underback panel being positioned between said median folds and a second of said ends of said board;

said backer panel being positioned beneath said tablet;

said underback panel being inserted between adjacent sheets of said tablet beneath said upper sheet of said tablet; and said underback panel having an upwardly extending generally L-shaped clip strip extending between said sides of said board, said clip strip being positioned adjacent said median folds, said clip strip having generally rectangular elongate upper and lower portions, said lower portion of said clip strip being coupled to said underback panel, said upper portion of said clip strip being extended from said lower portion of said clip strip towards said second end of said board.

2. The notepad of claim 1, wherein said board has a spaced apart pair of substantially parallel upper folds extending between said sides of said board and being positioned towards said first end of said board, said upper folds of said board defining a generally rectangular U-shaped spine region having spaced apart upper and lower portions, and a top portion connecting together said upper and lower portions of said spine region together, said top end of said tablet being positioned between said upper and lower portions of said spine region.

3. The notepad of claim 1, wherein a first of said sides of said tablet and a first of said sides of said board generally lie in a common plane with one another, wherein a second of said sides of said tablet and a second of said sides of said board generally lie in a common plane with one another, and wherein said common planes of said sides of said tablet and board are substantially parallel to one another.

4. The notepad of claim 1, wherein said median folds are extended substantially parallel to said ends of said board and substantially perpendicular to said sides of said board.

5. The notepad of claim 2, wherein said upper folds of said board are extended substantially parallel to said ends of said boards and substantially perpendicular to said sides of said board.

6. A notepad, comprising:

a generally rectangular tablet having substantially straight top and bottom ends, and a pair of substantially sides extending between said ends of said tablet;

said ends of said tablet being extended substantially parallel to one another, said sides of said tablet being extended substantially parallel to one another and substantially perpendicular to said ends of said tablet;

said tablet comprising a plurality of generally rectangular sheets coupled together along said top end of said tablet, said plurality of sheets being arranged in a stack in said tablet having a top sheet and a bottom sheet;

each of said sheets of said tablet having generally rectangular upper and lower faces;

said lower faces of said sheets each having a coating of duplicating material whereby applying localized pressure to said upper face of a first sheet to form a mark transfers pressure to the lower face of the first sheet such that said coating of duplicating material forms a copy of the mark on to a second sheet beneath the first sheet;

a generally rectangular board having a pair of substantially straight opposite ends, and a pair of substantially straight sides extending between said ends of said board;

said ends of said board being extended substantially parallel to one another, said sides of said board being extended substantially parallel to one another and substantially perpendicular to said ends of said board;

said board having a spaced apart pair of substantially parallel upper folds extending between said sides of said board and being positioned towards a first of said ends of said board, said upper folds of said board being extended substantially parallel to said ends of said boards and substantially perpendicular to said sides of said board;

said upper folds of said board defining a generally rectangular U-shaped spine region having spaced apart upper and lower portions, and a top portion connecting together said upper and lower portions of said spine region together;

said top end of said tablet being positioned between said upper and lower portions of said spine region and being positioned adjacent said top portion of said spine region, said top end of said tablet being coupled to said spine region;

a first of said sides of said tablet and a first of said sides of said board generally lying in a common plane with one another, a second of said sides of said tablet and a second of said sides of said board generally lying in a common plane with one another, said common planes of said sides of said tablet and board being substantially parallel to one another;

said board having a spaced apart pair of substantially parallel median folds extending between said sides of said board, said median folds being extended substantially parallel to said ends of said board and substantially perpendicular to said sides of said board;

said tablet being positioned between said spine region and said median folds of said board, said bottom end of said tablet being positioned adjacent said median folds of said board;

said median folds of said board dividing said board into generally rectangular backer and underback panels;

said backer panel being positioned between said median folds and said spine region of said board;

said underback panel being positioned between said median folds and a second of said ends of said board;

said backer panel being positioned beneath said bottom sheet of said tablet;

said underback panel being extended from said median folds towards said spine region of said board;

said underback panel being inserted between adjacent sheets of said tablet beneath said upper sheet of said tablet, wherein at least two sheets of said tablet are positioned about said underback panel;

said second end of said board being positioned adjacent said spine region of said board;

said underback panel having an upwardly extending generally L-shaped clip strip extending between said sides of said board, said clip strip being positioned adjacent said median folds and being extended substantially parallel to said ends of said board and substantially perpendicular to said sides of said board;

said clip strip having generally rectangular elongate upper and lower portions extending substantially perpendicular to one another;

said lower portion of said clip strip being coupled to said underback panel;

said upper portion of said clip strip being extended from said lower portion of said clip strip towards said second end of said board;

said upper portion of said clip strip and said underback panel defining a lower channel therebetween extending between sides of said board; and the sheets of said tablet positioned above said underback panel each having lower end edges inserted into said lower channel defined between said upper portion of said clip strip and said underback panel.

* * * * *